United States Patent [19]

Ryan et al.

[11] Patent Number: 4,527,540

[45] Date of Patent: Jul. 9, 1985

[54] CHILDREN'S SAFETY SHIELD FOR APPLIANCES

[76] Inventors: Kathryn A. Ryan; Gregory F. Ryan, both of 77 Erie St., Dumont, N.J. 07628

[21] Appl. No.: 621,960

[22] Filed: Jun. 18, 1984

[51] Int. Cl.[3] ..... F24C 3/12

[52] U.S. Cl. ..... 126/42; 126/201; 160/352

[58] Field of Search ..... 126/214 D, 201, 202, 126/42, 203, 277, 278; 160/DIG. 13, 352

[56] References Cited

U.S. PATENT DOCUMENTS

| | | | |
|---|---|---|---|
| 2,193,469 | 3/1940 | Ashton | 160/352 |
| 2,551,052 | 5/1951 | Quish et al. | 160/DIG. 13 |
| 2,887,154 | 5/1959 | Morningstar et al. | 160/352 |
| 2,911,038 | 11/1959 | Frommelt | 160/352 |
| 4,407,319 | 10/1983 | Schultz et al. | 160/352 |

FOREIGN PATENT DOCUMENTS

| | | | |
|---|---|---|---|
| 395450 | 7/1933 | United Kingdom | 126/202 |

*Primary Examiner*—James C. Yeung

*Attorney, Agent, or Firm*—Samuelson & Jacob

[57] ABSTRACT

A safety shield for isolating a heated appliance, such as a stove or an oven, from the reach of children includes a flexible sheet of material having securing portions along opposite vertical edges for securing the sheet adjacent the sides of the front face of the appliance and an arched shielding portion extending horizontally between the securing portions and spanning the front face of the appliance, the arched shielding portion being bowed outwardly away from the front face of the appliance to shield the appliance from the reach of children.

12 Claims, 5 Drawing Figures

CHILDREN'S SAFETY SHIELD FOR APPLIANCES

The present invention relates generally to child safety and pertains, more specifically, to a safety shield for isolating a heated appliance, such as an oven or a stove, from the reach of children.

Kitchen appliances always seem to have presented a certain attraction to toddlers and young children who, out of natural curiosity, have been drawn to such appliances, and especially to stoves and ovens. These particular appliances, now frequently placed in modern, built-in settings, appear to be quite benign, while displaying colorful pots and pans or other cooking utensils at the tops of stoves and viewing windows in oven doors, all of which are attractive to children, and can be dangerously hot.

While a variety of devices have been proposed in the past for guarding against inadvertent contact with hot stoves or for shielding stoves and ovens from accidental touching by adults as well as children, such devices have been cumbersome, unattractive, difficult to use and problematical when not in use and requiring storage. Moreover, these devices usually are constructed for particular appliances and are not adapted to serve universally in connection with a number of different appliance configuration and installations.

It is an object of the present invention to provide a safety shield which is effective in isolating heated appliances, such as stoves and ovens, from the reach of children.

Another object of the invention is to provide a safety shield of the type described and which is adapted readily for use with a variety of stoves and ovens, as well as other appliances, in a number of different installation configurations.

Still another object of the invention is to provide a safety shield of the type described and which is effective in protecting against injuries to children, yet still enables easy access to the appliance by an adult.

Yet another object of the invention is to provide a safety shield, as above, and which is easy to put into place so as to encourage its use whenever the appliance to be shielded is in use.

A further object of the invention is to provide a safety shield, as described, and which is easily removed and readily stored when not in use, for handy access so that storage will not discourage its use when necessary.

A still further object of the invention is to provide a safety shield of the type described and which is relatively simple and inexpensive in construction, is lightweight and easily handled, yet highly effective in use.

The above objects, as well as still further objects and advantages, are attained by the present invention which may be described briefly as a safety shield for isolating a heated appliance, such as a stove or an oven, from the reach of children, the appliance having a front face with a height extending between a top and a base and a width extending between vertical sides, the safety shield comprising: a sheet of flexible material extending horizontally between vertically-extending edges; securing portions integral with the sheet at the vertically-extending edges thereof; the sheet of flexible material including a shielding portion extending between the securing portions; and securing means carried by the securing portions for securing the securing portions adjacent the sides of the appliance with the shielding portion spanning the appliance and extending outwardly from the front face of the appliance to shield the appliance from the reach of children.

The invention will be understood more fully, while still further objects and advantages will become apparent, in the following detailed description of preferred embodiments of the invention illustrated in the accompanying drawing, in which.

Figure 1:
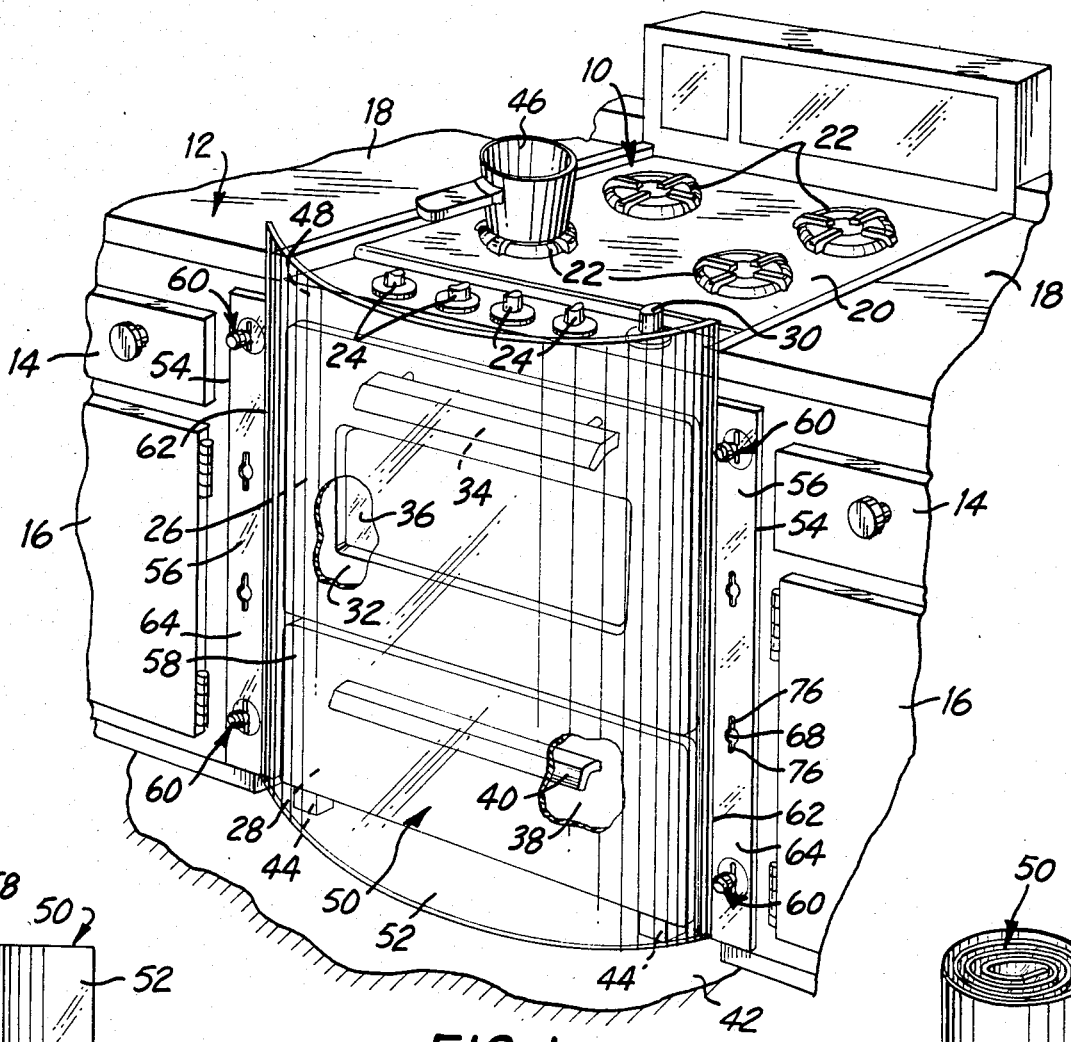
FIG. 1 is a pictorial view illustrating a safety shield constructed in accordance with the invention and installed over a gas range which includes a stove and an oven.

Referring now to the drawing, and especially to FIG. 1 thereof, an appliance in the form of a gas range 10 is installed within a kitchen counter assembly 12 having drawers 14 and cabinets 16 placed beneath a counter top 18 at either side of the gas range 10. Gas range 10 includes a stove top 20 for cooking, the stove top having burners 22 operated by controls 24. Gas range 10 further includes an oven 26 and a broiler 28 controlled by a further control 30. Oven 26 has a door 32 with a handle 34 and a transparent window 36 through which the oven contents may be viewed. Broiler 28 also includes a door 38 and a handle 40. Gas range 10 rests upon the floor 42 of the kitchen and includes feet 44 which raise the base of the gas range 10 slightly from the floor 42.

When the stove top 20 is in use, various cooking utensils, such as pot 46, are placed on the burners 22 and become attractions for toddlers and young children. When the oven 26 is in use, children are attracted by the window 36 which offers a view of the contents of the oven 26. Use of the oven 26 or the broiler 28 usually will heat up the respective doors 32 and 38 which make up the front face 48 of the appliance, while use of the stove top 20 usually will heat up the top of the appliance. Children attracted to the gas range 10 by colorful or otherwise interesting cooking utensils will reach for stove top 20 and may lean against the front face 48 of the appliance. Similarly, children seeking to look through window 36 may touch the heated front face 48. In addition, children playing in the vicinity of gas range 10 may inadvertently come into contact with heated surfaces of the appliance. Any of these occurrences can lead to injuries.

In order to shield gas range 10 from the reach of children, the present invention provides safety shield 50 which precludes contact, either deliberate or inadvertent, between a child and the front face 48 of the appliance. Shield 50 is constructed of a sheet 52 of material extending horizontally between opposite vertically-extending edges 54 and having securing portions 56 extending vertically along the sheet 52 adjacent the edges 54, and a shielding portion in the form of an arched portion 58 extending between the securing portions 56. Securing means shown in the form of suction cups 60 are carried by the securing portions 56 and are affixed to the counter assembly 12 adjacent either side of the gas range 10 so that the arched portion 58 spans the front face 48 of the appliance. Arched portion 58 is bowed outwardly away from the front face 48 a sufficient distance to remain cool enough to preclude injury to children who may contact shield 50. At the same time, the arched configuration lends strength to the shield 50 to prevent collapse of the arched portion 58 against the gas range 10. The vertical extent of arched portion 58 is great enough to preclude access by children to the stove top 20 and controls 24 and 30, as well as to any cooking utensils, such as pot 46 located on the stove top 20. However, access is available to adults.

Figure 2:
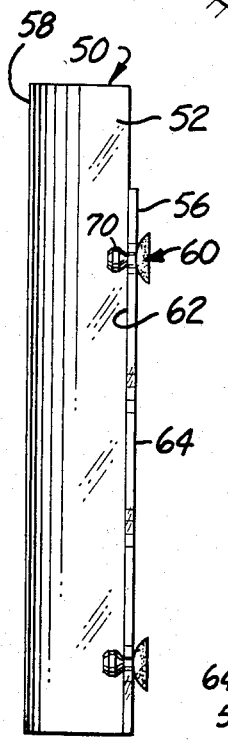
FIG. 2 is a side elevational view of the safety shield.
Figure 3:
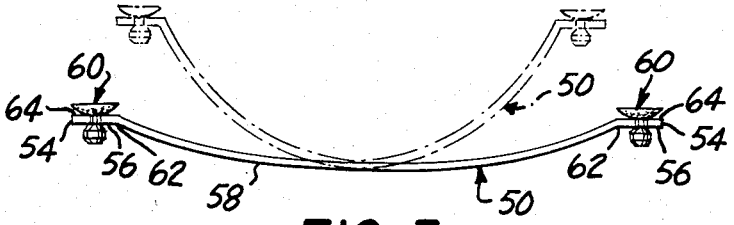
FIG. 3 is a top plan view of the safety shield, partially diagrammatic in nature, illustrating the adaptability of the safety shield.

As best seen in FIGS. 1 and 2, arched portion 58 of sheet 52 preferably is continuous and uninterrupted so that there is no room for catching a child's fingers in shield 50. Sheet 52 preferably is flexible so as to compensate for appliances of various widths. Thus, as illustrated in FIG. 3, arched portion 58 may be flexed to move securing portions 56 toward or away from one another to enable attachment of the securing portions 56 adjacent either side of a variety of appliances, with arched portion 58 spanning the front face of the appliance. Since most currently available stoves and ovens range in size from a width of about twenty-four inches to about thirty-six inches, shield 50 is constructed so that arched portion 58 will span a front face 48 as wide as thirty-six inches, as shown in full lines in FIG. 3, and as narrow as twenty-four inches, as shown in phantom in FIG. 3, with the arched portion 58 providing the appropriate shielding of access by children. The flexibility of the material of sheet 52 enables the illustrated expansion and contraction. At the same time, securing portions 56 preferably are hinged along hinge lines 62, as by a score line or the like, to the arched portion 58 to enable swinging of the securing portions 56 relative to arched portion 58 to maintain the securing portions 56 essentially parallel to the surfaces to which the securing portions will be attached, while allowing the arched portion 58 to be expanded or contracted horizontally.

Preferably sheet 52 is constructed of a synthetic resin material having the requisite flexibility to enable the horizontal expansion and contraction of arched portion 58, with sufficient rigidity to maintain the arched portion 58 against collapse when contacted by a child. A wide variety of synthetic resin materials is available which function properly. In the illustrated embodiment, the material of sheet 52 is transparent so that window 36 remains available for viewing the contents of oven 26. Securing portions 56 are in the form of securing strips 64 which are unitary with arched portion 58 and preferably are hinged to arched portion 58 by an integral plastic hinge located along each hinge line 62.

Figure 4:
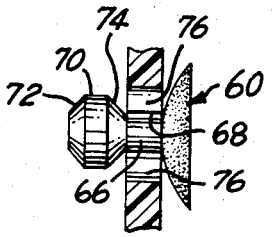
FIG. 4 is an enlarged fragmentary view showing a securing suction cup placed in the safety shield.

As best seen in FIG. 4, each suction cup 60 is mounted upon a securing strip 64 by a unitary stem 66 extending through an aperture 68 in the securing strip 64 and carrying a button 70 which retains the suction cup 60 and stem 66 in place. A plurality of apertures 68 is located in each securing strip 64, the number of apertures 68 being greater than the number of suction cups 60. Thus, each suction cup 60 may be located selectively in any aperture 68 so that suction cups 60 can be placed at positions appropriate for the particular surface to which the securing strips 64 will be attached. Should there be some structure, such as a drawer or cabinet door, which interferes with the placement of a suction cup 60 at a particular location, the suction cup can be moved to select a position where the suction cup 60 will be effective to attach the securing strip 64 to an underlying support structure. To this end, the buttons 70 each include tapered surfaces 72 and 74 for facilitating the selective insertion or removal of a button 70 through an aperture 68 to attach or detach corresponding suction cup 60 to or from a securing strip 64. Apertures 68 each are provided with radial slots 76 which will ease dilation of the apertures 68 during insertion and removal of a button 70. The suction cups 60 are constructed of an elastomeric material so that buttons 70 will be deformed resiliently to further enable such insertion and removal. Alternate securing devices, such as adhesive strips or Velcro fasteners are feasible.

Figure 5:
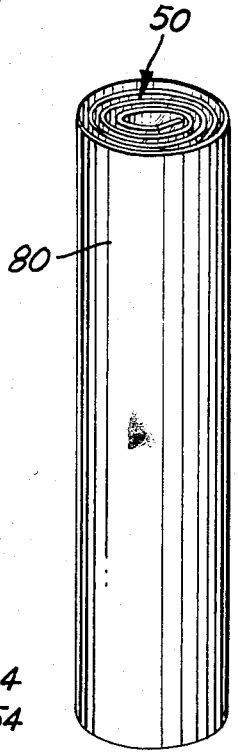
FIG. 5 is a perspective view of an alternate embodiment of the safety shield shown rolled into a storage configuration.

The relatively thin and flexible nature of sheet 52 renders shield 50 lightweight and easy to handle and store. Installation is simple, merely requiring that the shield 50 be placed over the front face of the appliance and secured in place with suction cups 60. When not in use, shield 50 may be removed and stored in a flat configuration, requiring minimal space, usually available in cabinets or behind doors. Alternately, sheet 52 may be made flexible enough to enable shield 50 to be rolled into a tubular configuration and placed within a tubular container 80, as illustrated in FIG. 5, for storage in a broom closet or a like storage facility. Thus, shield 50 will remain handy and its use will not be discouraged by requiring a remote storage location.

It will be seen that the safety shield 50 is simple in construction and inexpensive to manufacture. Ease of use and storage will encourage the employment of safety shield 50 in the home so that children will be protected against injury.

It is to be understood that the above detailed description of embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. A safety shield for isolating a heated appliance, such as a stove or an oven, from the reach of children, the appliance having a front face with a height extending between a top and a base and a width extending between vertical sides, the safety shield comprising:

a sheet of flexible material extending horizontally between vertically-extending edges;

securing portions integral with the sheet at the vertically-extending edges thereof;

the sheet of flexible material including a shielding portion extending between the securing portions; and securing means carried by the securing portions for firmly securing the securing portions with respect to the sides of the appliance such that the shielding portion is in fixed position spanning the appliance and extending outwardly from the front face of the appliance in an outwardly bowed reinforcing configuration to shield the appliance from the reach of children;

the shielding portion being provided with sufficient rigidity as a result of the firmly secured securing portions and the outwardly bowed reinforcing configuration to resist collapse of the flexible material inwardly toward the front face of the appliance in response to contact by said children.

2. The invention of claim 1 wherein the shielding portion is arched outwardly from the front face of the appliance to establish said outwardly bowed reinforcing configuration.

3. The invention of claim 2 wherein the shielding portion extends vertically from adjacent the base of the appliance face to adjacent the top of the appliance face.

4. The invention of claim 3 wherein the sheet is continuous throughout the shielding portion.

5. The invention of claim 4 wherein the sheet is constructed of a synthetic resin material.

6. The invention of claim 5 wherein the material of the sheet is transparent.

7. The invention of claim 2 wherein the securing portions are hinged to the shielding portion for accommodating appliances having faces of different widths.

8. The invention of claim 2 wherein the securing portions include securing strips extending continuously along the vertically-extending edges of the sheet.

9. The invention of claim 8 wherein the securing portions are hinged to the shielding portion for accommodating appliances having front faces of different widths.

10. The invention of claim 8 including means for placing the securing means at selected positions on the securing strips for accommodating a particular installation.

11. The invention of claim 10 wherein the securing strips are hinged to the shielding portion for accommodating appliances having front faces of different widths.

12. The invention of claim 1, 2, 5, 6, 7, 9 or 11 wherein the securing portions are unitary with the shielding portion.

* * * * *